US006036241A

United States Patent [19]

Ostdiek et al.

[11] Patent Number: 6,036,241

[45] Date of Patent: Mar. 14, 2000

[54] LOCKING MECHANISM FOR AN APPLIANCE DOOR

[75] Inventors: Stephen D. Ostdiek, Newton; Evan R. Vande Haar, Pella; Michael W. Winders, Newton, all of Iowa

[73] Assignee: Maytag Corporation, Newton, Iowa

[21] Appl. No.: 09/037,955

[22] Filed: Mar. 11, 1998

[51] Int. Cl.[7] ..... E05C 3/02

[52] U.S. Cl. ..... 292/229; 292/DIG. 69; 292/199; 292/201

[58] Field of Search ..... 292/DIG. 69, 214, 292/199, 201, 216, 117, 122, 106, 240, 220, 198, DIG. 27; 192/69.8, 69.7, 136; 68/12.26; 200/61.62, 61.69, 61.64

[56] References Cited

U.S. PATENT DOCUMENTS

| | | | |
|---|---|---|---|
| 2,684,741 | 7/1954 | Gregory | 192/69.8 |
| 2,910,317 | 10/1959 | Conlee | 292/201 |
| 2,936,892 | 5/1960 | McNeil et al. | 292/201 |
| 3,204,131 | 8/1965 | Wright, Jr. | 192/69.8 |
| 3,602,015 | 8/1971 | Hughes | 68/12 |
| 3,617,957 | 11/1971 | Brighentl | 337/77 |
| 3,623,343 | 11/1971 | Haller et al. | 68/139 |
| 3,638,457 | 2/1972 | Filipak | 68/12 R |
| 3,673,824 | 7/1972 | Ripsco et al. | 68/12 R |
| 3,674,952 | 7/1972 | Ellenberger | 200/61.64 |
| 4,032,180 | 6/1977 | Pohl | 292/341.16 |
| 4,094,541 | 6/1978 | Simms | 292/231 |
| 4,179,907 | 12/1979 | Schantz | 68/12 R |
| 4,184,704 | 1/1980 | Ross | 292/201 |
| 4,268,076 | 5/1981 | Itoi | 292/216 |
| 4,286,811 | 9/1981 | Schantz | 292/201 |
| 4,342,476 | 8/1982 | Brown et al. | 292/201 |
| 4,623,179 | 11/1986 | Davis et al. | 292/201 |
| 4,635,454 | 1/1987 | Brown | 70/139 |
| 4,988,132 | 1/1991 | Rocchitelli | 292/144 |
| 5,323,628 | 6/1994 | Mori et al. | 68/12.26 |
| 5,639,130 | 6/1997 | Roger, Jr. et al. | 292/216 |
| 5,691,520 | 11/1997 | Hapke et al. | 200/61.62 |
| 5,823,017 | 10/1998 | Hapke et al. | 68/12.26 |

FOREIGN PATENT DOCUMENTS

| | | |
|---|---|---|
| 359 728 | 3/1990 | European Pat. Off. . |
| 381 022 | 8/1990 | European Pat. Off. . |
| 384 148 | 8/1990 | European Pat. Off. . |
| 518 147 | 12/1992 | European Pat. Off. . |
| 1 508 575 | 4/1978 | United Kingdom . |
| 1 535 628 | 12/1978 | United Kingdom . |
| 1 536 686 | 12/1978 | United Kingdom . |
| 2 015 070 | 9/1979 | United Kingdom . |
| 2 075 109 | 11/1981 | United Kingdom . |
| 2 094 556 | 9/1982 | United Kingdom . |
| 2 107 383 | 4/1983 | United Kingdom . |
| 2 118 266 | 10/1983 | United Kingdom . |
| 2 128 283 | 4/1984 | United Kingdom . |
| 2 158 146 | 11/1985 | United Kingdom . |
| 2 162 240 | 1/1986 | United Kingdom . |
| 2 165 911 | 4/1986 | United Kingdom . |
| 2 174 140 | 10/1986 | United Kingdom . |
| 2 196 689 | 5/1988 | United Kingdom . |
| 2 203 245 | 10/1988 | United Kingdom . |
| 88/05476 | 7/1988 | WIPO . |

*Primary Examiner*—Darnell M. Boucher
*Assistant Examiner*—John B. Walsh
*Attorney, Agent, or Firm*—Everett G. Diederiks, Jr.

[57] ABSTRACT

A mechanism for locking an access door of an appliance includes a spring biased catch member preferably attached to the door and a latching housing insert fixed to a cabinet shell of the appliance. Upon closing the door, the catch member is caused to ride up a ramped retaining element mounted in a latching cavity, while simultaneously pivoting a first locking element between release and set positions. When the door is fully closed, the catch member drops behind the retaining element to releasably hold the door closed. When it is desired to maintain the door in a securely locked position, a linear actuator is activated to shift a second locking element into engagement with the first locking element. Preferably, the first and second locking elements are engaged through a ratchet connection which enables continued rotation of the first locking element to only further lock the catch member in the latching cavity. De-activation of the linear actuator enables opening of the door, preferably in a timed and controlled manner in accordance with a safety unlocking algorithm.

30 Claims, 5 Drawing Sheets

LOCKING MECHANISM FOR AN APPLIANCE DOOR

BACKGROUND OF THE INVENTION

1. Field of the Invention

The present invention pertains to the art of appliances and, more particularly, to a locking mechanism for the door of an appliance.

2. Discussion of the Prior Art

The desire to lock an access door of an appliance in a closed position for various reasons is recognized in the art. Particularly, it is often desired to assure the positive locking of an appliance door during certain operating modes for safety reasons. For instance, the need for an access door locking arrangement is particularly realized in horizontal axis or tumble-type washing machines. As the basket of such a washing machine is caused to rotate at a relatively high speed during a spin mode, if the access door was permitted to be inadvertently opened at this time, an injury may be inflicted upon an operator's limb by the rotating basket. Due to at least this safety concern, it is now a UL requirement that any horizontal axis washer manufactured in the United States lock the door during a spin mode of operation or the appliance must stop within a limited time period.

Of course, the need to incorporate a locking mechanism in an appliance adds to the associated manufacturing costs. In addition, the need to provide a locking mechanism introduces certain design constraints and considerations. For example, given the life expectancy of typical household appliance, the locking mechanism must be effectively designed for reliable operation over a prolonged period of time. Therefore, the mechanism must accommodate manufacturing tolerances and possible relative shifting between the access door and a cabinet of the appliance over its useful life in order to avoid the need for independent adjusting of the locking mechanism for proper operation.

Although various locking mechanisms for washing machines and other appliances have already been proposed in the art, in general, these known arrangements are considered to have shortcomings, e.g. in the ease of assembly thereof, associated cost and/or the need to be periodically adjusted over time, such that presently a need exists in the art for an improved mechanism for reliably locking the access door of an appliance.

SUMMARY OF THE INVENTION

The present invention is directed to a mechanism particularly adapted for use in locking a pivotal access door of an appliance in a closed position during predetermined modes of operation of the appliance. The locking mechanism incorporates structure for releasably retaining the door in a closed position upon initially positioning the door across an access opening of the appliance and additional structure for positively locking the door in the closed position when the appliance is operating in one or more predetermined modes.

In accordance with the preferred embodiment, a spring biased catch member is attached to the access door, with the catch member being received within a latching cavity of the locking mechanism upon closing of the door. A ramp member is arranged in the latching cavity and the catch member is adapted to ride upon and fall behind a rear Sloping surface of the ramp member in order to releasably retain the door closed. When entering the latching cavity, the catch member also causes pivoting of a first locking element from a release position to a set position.

When the appliance is used in one or more modes of operation which could present a hazardous situation if the access door was opened, a second locking element is caused to shift into engagement with the first locking element so as to positively maintain the door in the closed position. In accordance with the most preferred form of the invention, the second locking element includes a gear portion that is adapted to linearly shift into engagement with a rotatable hub portion of the first locking element such that ratchet teeth associated with the gear and hub portions become interengaged. The presence of the ratchet teeth enables further shifting of the door in a closing direction, while still preventing the door from opening until the second locking element is shifted to an unlocking position.

The shifting of the second locking element to the locking position is prevented, due to stop abutments acting between the gear and hub portions, until the first locking element has been caused to rotate a certain extent by engagement with the catch member. When shifted to the locking position, the second locking element also preferably causes actuation of one or more switches used to signal the operator of the locked condition, as well as to verify the condition to a controller used to establish the operational modes of the appliance. During an unlocking procedure, the shifting of the second locking element is done in a timed is and controlled manner.

The biasing of the catch member, the configuration of the latching cavity, the inclusion of the ramp and the arrangement of the first and second locking elements, enables these components to be assembled and operate with a rather high degree of tolerance, while still ensuring that the catch member will be properly positioned behind the ramp and the first locking element will be caused to pivot upon closing of the door. Therefore, necessary adjustments to the overall locking mechanism based on any variances in the manufacturing of the door, appliance cabinet and other components can be effectively minimized. In addition, the overall construction of the locking mechanism provides an efficient and reliable locking system.

Additional objects, features and advantages of the present invention will become more readily apparent from the following detailed description of the preferred embodiment thereof, when taken in conjunction with the drawings wherein like reference numerals refer to corresponding parts in the several views.

DETAILED DESCRIPTION OF THE PREFERRED EMBODIMENT

Figure 1:
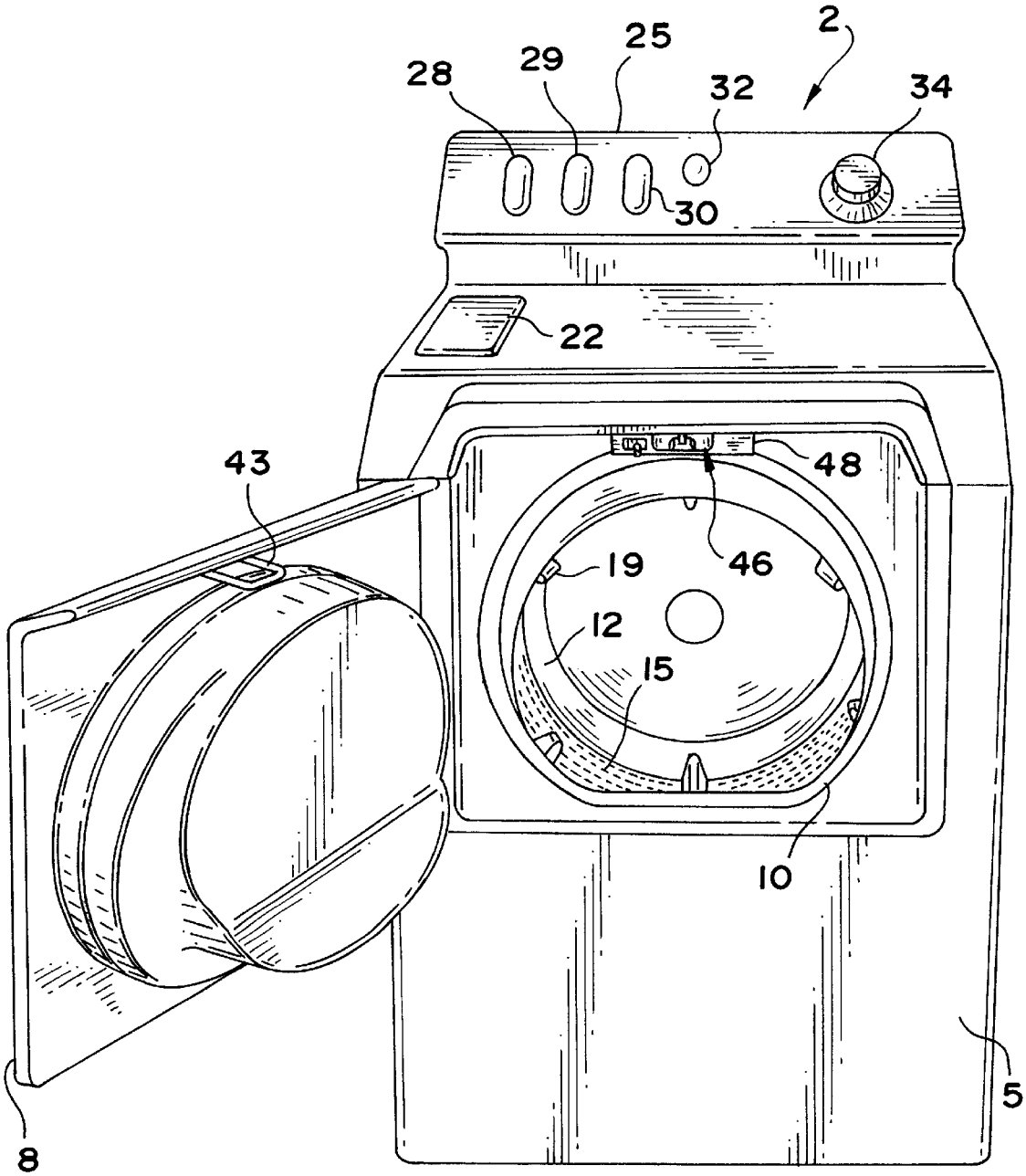
FIG. 1 is a front perspective view of a horizontal axis washing machine incorporating the locking mechanism of the present invention.

With initial reference to FIG. 1, an automatic washing machine incorporating a locking mechanism constructed in accordance with the present invention is generally indicated at 2. In the embodiment shown, washing machine 2 constitutes a horizontal axis or tumble-type washer that is adapted to be front loaded with articles of clothing to be laundered. As shown, automatic washing machine 2 incorporates an outer cabinet shell 5 which is provided with a front door 8 adapted to extend across an access opening 10, but which can be opened to provide access to a washing basket 12. Washing basket 12 is mounted within outer cabinet shell 5 for rotation about an axis which is actually angled slightly downwardly and rearwardly. As is known in the art, washing basket 12 includes a plurality of holes 15, as well as a plurality of radially inwardly projecting fins or blades 19 which are fixedly secured to washing basket 12. In a manner known in the art, washing basket 12 is adapted to rotate during both wash and rinse cycles such that articles of clothing placed therein actually tumble through either water/detergent or water supplied within washing basket 12. Of course, washing basket 12 is adapted to be driven by a motor (not shown) with the motor preferably being constituted by a variable speed, reversible electric motor.

For the sake of completeness, automatic washing machine 2 is also shown to include an upper cover 22 that provides an access area for adding detergent, softeners and the like. In addition, an upper control panel 25, including various selector buttons 28–30, an indicator light 32 and a control knob 34, is provided for manually establishing a desired washing operation in a manner known in the art. During certain cycles of washing machine 2, washing basket 12 will be caused to spin at a rather high rate of speed. Obviously, the rotation of washing basket 12 in this manner could represent a hazardous situation if front door 8 were permitted to be inadvertently opened while washing basket 12 is spinning. To avoid this potentially dangerous situation, a locking mechanism is incorporated in washing machine 2 in accordance with the present invention. In the embodiment shown, the locking mechanism includes a catch member 43 which preferably projects from an inside surface of front door 8 and which is adapted to be received in a latching cavity 46 formed as part of a latching insert housing 48 that is secured to cabinet shell 5. The present invention is particularly directed to the manner in which catch member 43 is received and lockingly maintained is within latching cavity 46, and the preferred form of the invention will now be detailed with reference to the remaining drawings.

Figure 2:
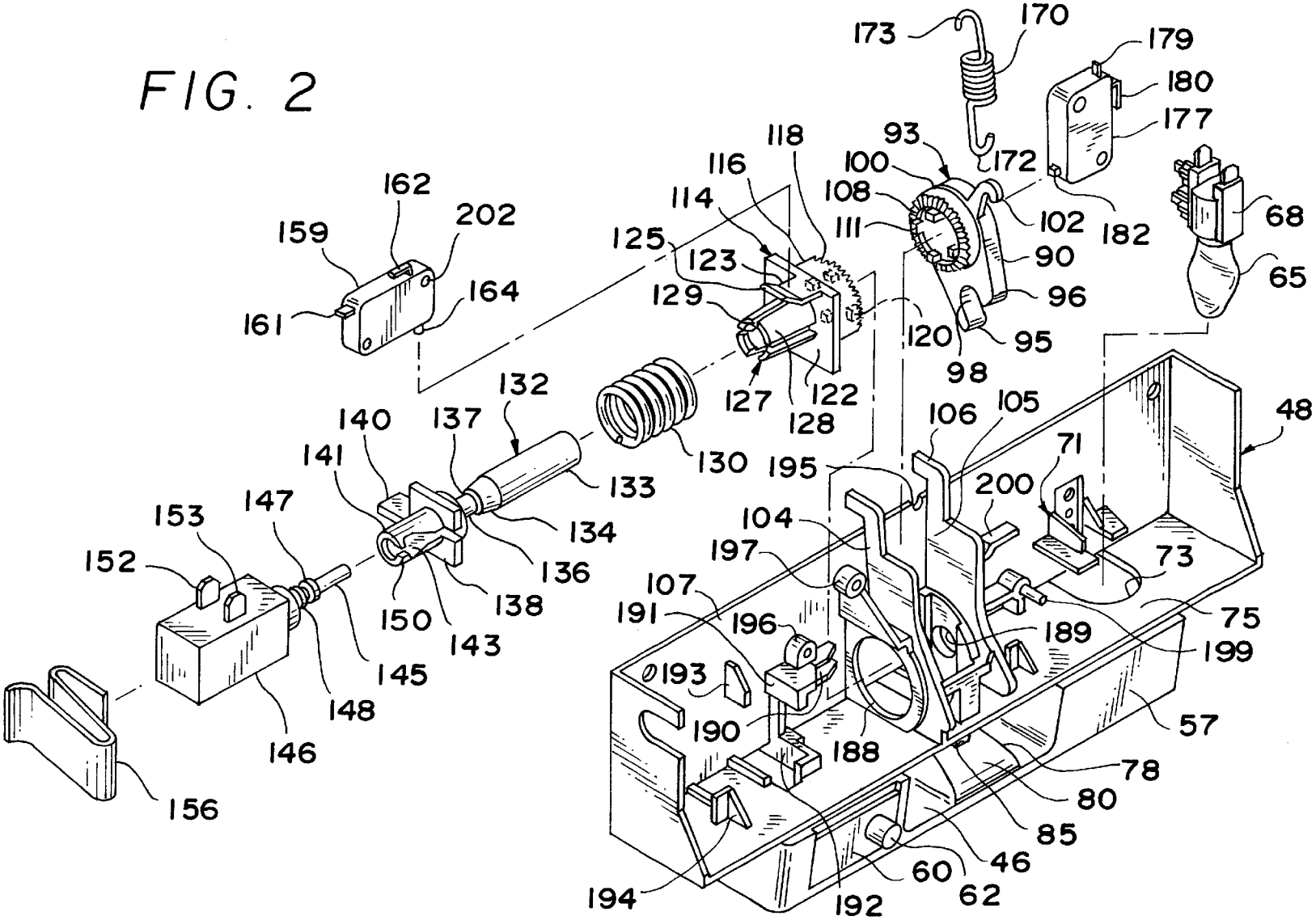
FIG. 2 is an exploded view of the locking mechanism of the invention.

FIG. 2 illustrates the various components incorporated into insert housing 48. Insert housing 48 includes a front panel portion 57 which is exposed from a front view of washing machine 2 as clearly shown in FIG. 1. Front panel portion 57 is adapted to receive a switch 60, preferably in a snap-fit manner, with switch 60 including a plunger 62. Plunger 62 is adapted to be engaged upon closing of front door 8 to enable operation of washing machine 2 and is also electrically connected to a light unit 65 threadably secured in a receptacle 68. Receptacle 68 is adapted to be secured in a molded mounting support unit 71 formed as part of insert housing 48 with light unit 65 extending through a hole 73 formed in a base plate 75 of insert housing 48. In any event, the depression of plunger 62 functions to turn off light unit 65 upon closing of front door 8. As such a switch controlled lighting arrangement is well known in the art of appliances and does not form part of the present invention, it will not be further discussed herein.

Positioned within latching cavity 46 is a retaining element 78. In the preferred form of the invention, retaining element 78 is formed as a separate element that is secured within latching cavity 46 by means of mechanical fasteners (not shown). Given that insert housing 48 is preferably molded of plastic, it should be readily recognized that retaining element 78 could also be integrally molded in position. In any event, retaining element 78 preferably takes the form of a ramp having a front sloping surface 80 that leads to a downwardly sloping rear wall 82 (see FIGS. 3 and 4). Retaining element 78 is preferably provided with a central cut-out 85 within which is adapted to be shiftably mounted a latching portion 90 of a first locking element 93. As clearly shown, latching portion 90 preferably constitutes a forked section defined by a pair of spaced fingers 95 and 96 with a slot 98 therebetween. First locking element 93 also includes a hub portion 100, as well as a hook arm 102. First locking element 93 is adapted to be positioned between a pair of upright mounting plates 104 and 105 which terminate in a pair of upper locator tips 106 that project rearwardly of an upstanding rear wall 107 of insert housing 48. Locator tips 106 are merely utilized in properly positioning insert housing 48 within cabinet shell 5. Hub portion 100 of first locking element 93 is formed with a central through hole (not labeled) and a first set of teeth 108 that preferably extends around the entire side surface of hub portion 100. In addition, positioned radially inwardly of first set of teeth 108 and projecting laterally beyond the teeth are annually spaced stop abutments 111.

Adapted to be arranged adjacent to and cooperate with first locking element 93 is a second locking element 114. In the preferred embodiment shown, second locking element 114 includes a gear portion 116 that is provided with a circumferential second set of teeth 118, as well as a plurality of stop abutments 120 which are constructed and arranged in a manner corresponding to stop abutments 111. For reasons which will be more fully described below, each of the first and second sets of teeth 108 and 118 preferably constitutes ratchet teeth which, even when interengaged, will permit rotation of first locking element 93 relative to second locking element 114 in a single rotational direction.

Second locking element 114 also includes a plate portion 122 from which extends an arm 123 having an up-turned terminal end 125. Projecting from one surface of plate 122 is a slitted sleeve extension 127. Sleeve extension 127 is generally conical in shape and preferably constituted by four annually spaced, resilient legs 128 that terminate in clip portions 129. Sleeve extension 127 is adapted to receive a compression spring 130 around legs 128 and a locking shaft 132 therethrough. Locking shaft 132 is preferably constructed with a uniform diametric portion 133, a tapered portion 134 and a reduced diametric portion 136. The juncture between the reduced diametric portion 136 and the tapered portion 134 defines a shoulder 137. Reduced diametric portion 136 is preferably integrally molded with an abutment plate 138 having an associated lateral tab 140.

Locking shaft 132 also includes an extension section 141 which is open on one side so as to define a receiving zone 143. Receiving zone 143 is adapted to receive an activating rod 145 of a linear actuator 146. In the preferred embodiment, linear actuator 146 constitutes a wax motor. More specifically, activating rod 145 has formed therealong a pair of axially spaced, annular rings 147 and 148 such that, when positioning of activating rod 145 within receiving zone 143, activating rod 145 is snapped into engagement with extension section 141 of locking shaft 132 with annular rings 147 and 148 being located on opposing sides of a slotted end 150 of extension section 141. Due to this iinterconnection, the extension and retraction of activating rod 145 of linear actuator 146 causes corresponding movement of locking shaft 132. This linear movement of activating rod 145 is based on electrical current being passed through linear actuator 146 by means of electrical prongs 152 and 153, with the supply of electrical current being controlled through control panel 25 in the manner which will be described more fully below.

Further incorporated as part of the locking mechanism of the present invention is a bent plate spring 156 which is used to bias the housing of linear actuator 146 axially. In addition, a first switch 159 is provided which includes associated electrical connectors 161 and 162 and a switching contact 164 adapted to be engaged by the up-turned terminal end 125 of arm 123 upon shifting of locking shaft 132 as will be discussed below. Preferably first switch 159 is linked to light 32 on control panel 25 in order to provide an indication to the operator that front door 8 is locked. Further provided within insert housing 48 is a spring 170 having a first hooked end 172 that is adapted to extend about hook arm 102 of first locking element 93 and a second hooked end 173 that is adapted to be attached to upstanding rear wall 107 as will be detailed below in fully describing the assembly of the locking mechanism. Finally, the locking mechanism includes a second switch 177 having associated electrical connectors 179 and 180 and a switching contact 182.

In assembling the locking mechanism of the present invention, compression spring 130 is placed over uniform diametric portion 133 of locking shaft 132 and then uniform diametric portion 133 is inserted into sleeve extension 127 of second locking element 114. Due to the diameter of diametric portion 133, legs 128 will be caused to flex outwardly such that diametric portion 133 will extend completely through the second locking element 114 until the clips 129 of legs 128 engage shoulder 137 of locking shaft 132. At this point, compression spring 130 will be compressed between plate 122 and abutment plate 138. Due to the interengagement between clips 129 and shoulder 137, second locking element 114 will be prevented from shifting relative to locking shaft 132 in the direction of tapered portion 134. However, due to the presence of reduced diametric portion 136, second locking element 114 will be permitted to shift towards abutment plate 138 a distance defined by the length of reduced diametric portion 136, while further compressing spring 130.

With first locking element positioned such that latching portion 90 projects into latching cavity 46 and hub portion 100 is positioned between upright mounting plates 104 and 105, the combined component of second locking element 114, compression spring 130 and locking shaft 132 is inserted into housing 48 with gear portion 116 of second locking element 114 extending through an enlarged hole 188 formed in upright mounting plate 104. Given that second locking element 114 is slid over uniform diametric portion 133 of locking shaft 132 upon assembly, diametric portion 133 projects through second locking element 114 beyond gear portion 116. Therefore, when first locking element 93 is positioned in the manner described above and gear portion 116 is inserted through enlarged hole 188, an end of uniform diametric portion 133 will extend entirely through hub portion 100 of first locking element 93 and also through a bore 189 formed in upright mounting plate 105. With this arrangement, uniform diametric portion 133 of locking shaft 132 will be able to shift linearly relative to first locking element 93 and will define an axis about which first locking element 93 can pivot.

Figure 3:
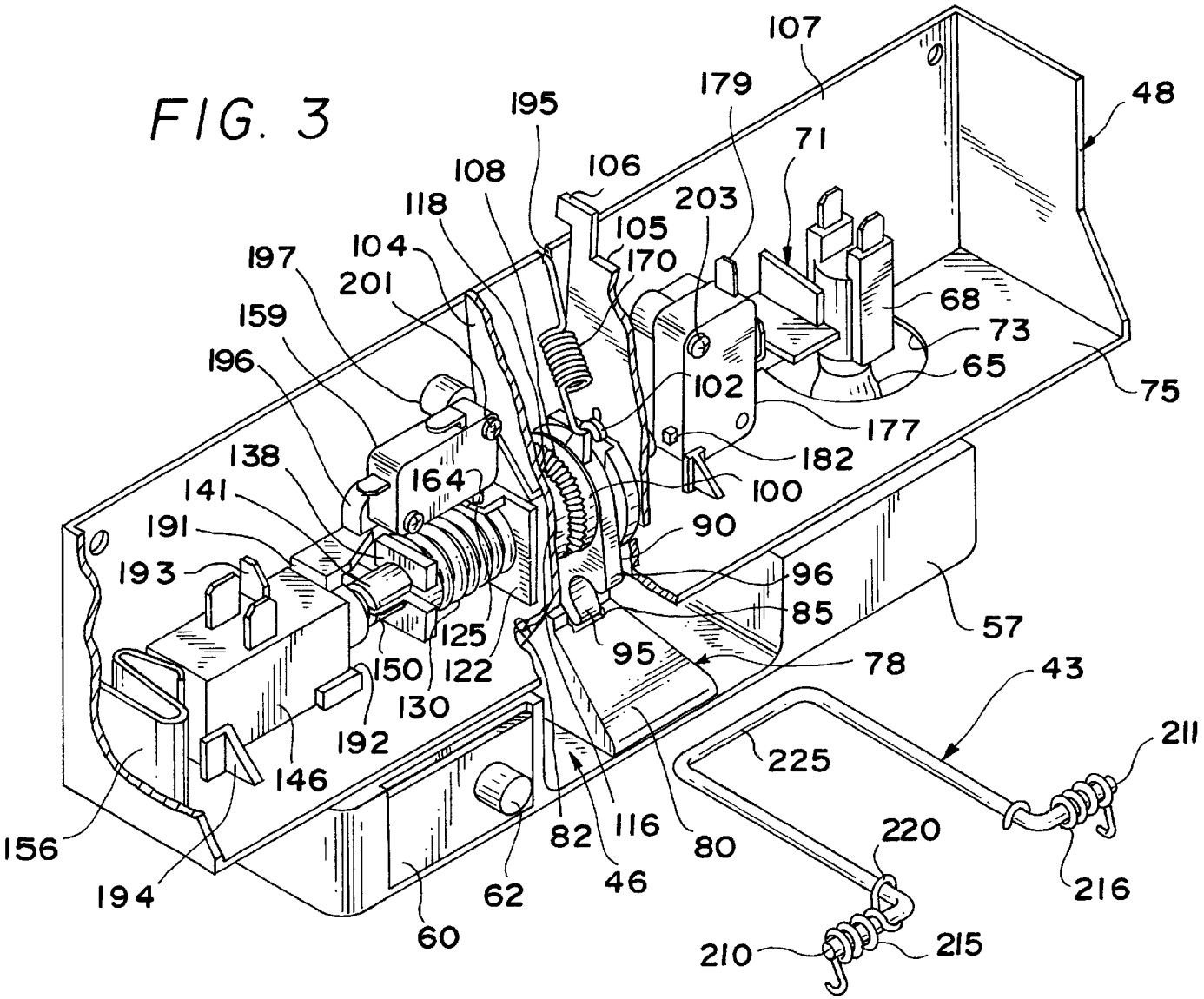
FIG. 3 is an assembled view of the locking mechanism of FIG. 2 in an unlocked position.

With second locking element 114 and locking shaft 132 not quite in their fully assembled position shown in FIG. 3, linear actuator 146 can be connected to extension section 141. More specifically, activating rod 145 is snap-fittingly placed within receiving zone 143 with annular rings 147 and 148 being arranged on opposite sides of slotted end 150 of extension section 141. Due to this interconnection, locking shaft 132 cannot shift without a corresponding extension or retraction of activating rod 145. Once this interconnection is made, linear actuator 146 can be placed in the position shown in FIGS. 3 and 4. More specifically, linear actuator 146, locking shaft 132, compression spring 130 and second locking element 114 can be maneuvered such that tab 140 of abutment plate 138 is received within a linear guide channel 190 formed along upstanding rear wall 107 and linear actuator 146 is received against various forward positioning walls 191 and 192, as well as gusseted locators 193 and 194. Once this appropriate positioning is carried out, bent plate spring 156 is inserted between insert housing 48 and linear actuator 146 such that linear actuator 146 is maintained against positioning walls 191 and 192.

Figure 4:
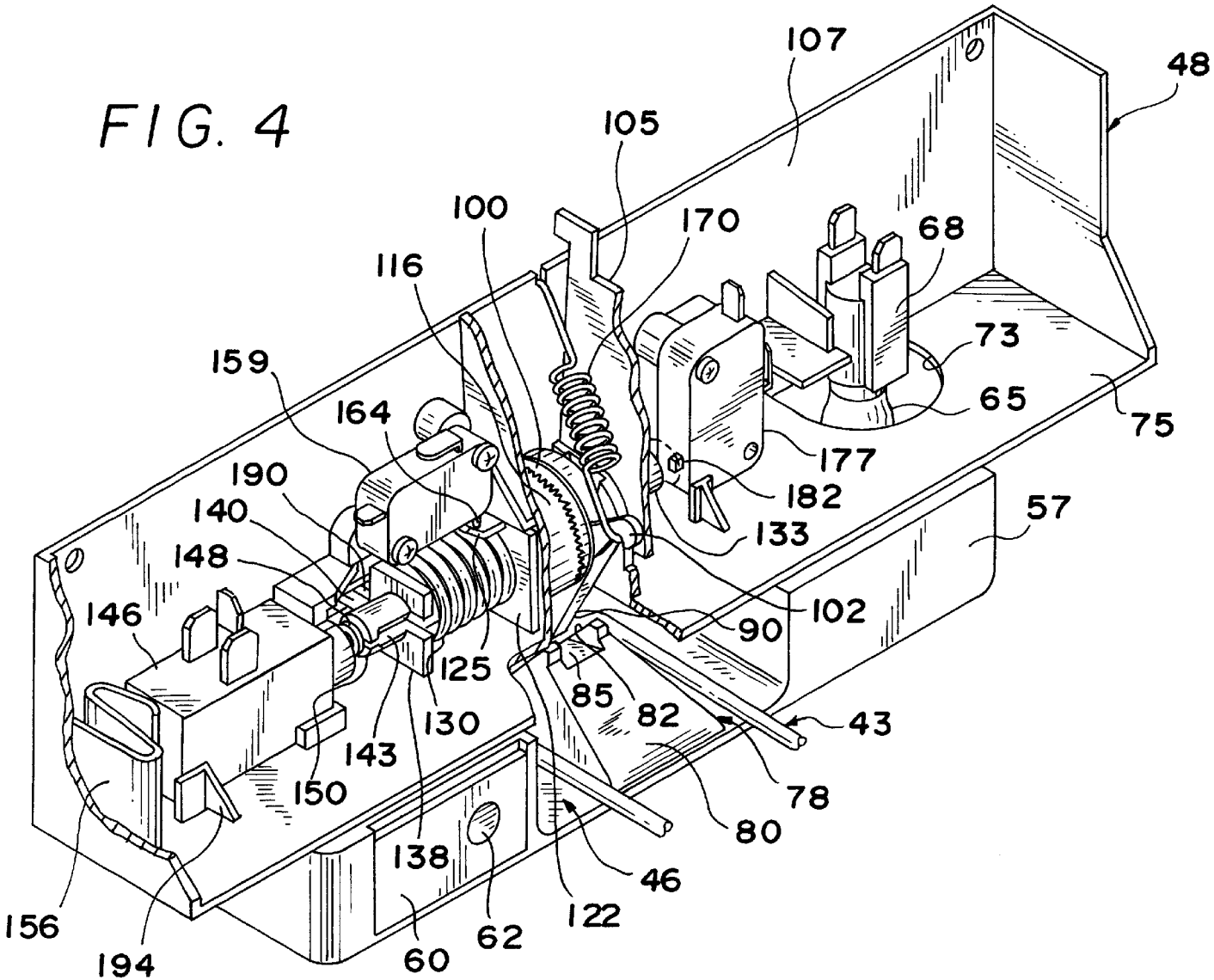
FIG. 4 is a view similar to that of FIG. 3, but with the locking mechanism in a fully locked position.

At this point, first locking element 93 is retained between upright mounting plates 104 and 105 and can pivot about uniform diametric portion 133 of locking shaft 132. In addition, the preferred embodiment provides a limited amount of play for first locking element 93 in the axial direction. However, spring 170 is then connected such that end 172 is received around hook arm 102 and end 173 of spring 170 engages upstanding rear wall 107 at a crevice 195. As shown in FIGS. 3 and 4, the spring is preferably angled in order to provide a biasing force that tends to pull first locking element 93 to the right as shown in these figures. In addition, spring 170 tends to cause first locking element 93 to assume the position shown in FIG. 3 wherein finger 95 generally represents an extension of front sloping surface 80 of retaining element 78 such that, upon closing of front door 8, catch member 43 will be caused to slide into slot 98. Further insertion of catch member 43 within latching cavity 46 upon closing of front door 8 will then cause pivoting of first locking element 93 as will be explained more fully below.

Final assembly of the locking mechanism merely requires first switch 159 to be secured at mounting bosses 196 and 197; second switch 177 to be secured at peg 199 and mounting boss 200; and receptacle 68 to be secured at molded mounting support unit 71, preferably in a snapfit manner with upstanding rear wall 107, while light unit 65 projects through hole 73. In accordance with the preferred embodiment shown, first switch 159 is preferably mounted through the use of screws 201 that extend through respective apertures 202 and second switch 177 is mounted with peg 199 extending into an aperture 202 and a screw 203 being secured to mounting boss 200.

As best shown in FIG. 3, catch member 43 is generally U-shaped, while including out-turned extensions 210 and 211. These out-turned extensions 210 and 211 are adapted to receive portions of respective springs 215 and 216, each of which has a first end 220 extending over one leg of the U-shaped catch member 43 and a second end which is adapted to engage a portion of front door 8. In this manner, catch member 43 is biased downward as viewed in FIG. 1 by means of springs 215 and 216. With this arrangement, when front door 8 is closed across access opening 10 of cabinet shell 5, a leg connecting portion 225 of catch member 43 will be caused to ride up upon front sloping surface 80 of retaining element 78. Due to the sloping of front surface 80, springs 215 and 216 will be caused to coil, thereby tending to shift catch member 43 downward. As indicated above, further closing of front door 8 will cause leg connecting portion 225 of catch member 43 to be received within slot 98 of latching portion 90. Still further insertion of catch member 43 will cause first locking element 93 to rotate about the axis defined by locking shaft 132. This pivoting of first locking element 93 will cause extension of spring 170 such that there is a tendency for first locking element 93 to assume the position shown in FIG. 4. Due to the downward biasing force created by springs 215 and 216, once leg connecting portion 225 of catch member 43 reaches the peak associated with retaining element 78, catch element 43 will be caused to shift downward within latching cavity 46 so as to assume a position behind rear wall 82 as best shown in FIG. 4.

Therefore, catch member 43 will abut rear wall 82 of retaining element 78 to releasably hold catch member 43 within latching cavity 46. However, a tug on front door 8 will cause catch member 43 to ride up rear wall 82, which is also angled as clearly shown in FIGS. 3 and 4, so as to enable opening of front door 8 and access to washing basket 12. Prior to the rotation of first locking element 93 by the insertion of catch member 43 within latching cavity 46, i.e., the locking mechanism is in the position shown in FIG. 3, plate 122 of second locking element 114 is axially spaced from upright mounting plate 104, contact 164 of first switch 159 is not depressed and abutment stops 111 are aligned with abutment stops 120 such that axial shifting of second locking element 114, even upon actuation of linear actuator 146, is prohibited. In other words, even if linear actuator 146 was operated to cause extension of activating rod 145, locking shaft 132 would merely shift linearly relative to second locking element 114, with compression spring 130 being further compressed and clips 129 of sleeve extension 127 merely riding along reduced diametric portion 136. Furthermore, since second locking element 114 cannot shift at this point due to the engagement between abutment stops 111 and 120, terminal end 125 of arm 123 cannot close contact 164 and locking shaft 132 is limited in travel so as to be prevented from closing contact 182. Therefore, in this condition, gear portion 116 of second locking element 114 remains spaced from hub portion 100 of first locking element 93 such that first locking element 93 can rotate relative to second locking element 114 when engaged by catch member 43 as described above. However, upon full insertion of catch member 43 within latching cavity 46, first locking element 93 is rotated from a release position (FIG. 3) to a set position (FIG. 4). At this point, stop abutments 111 and 120 will no longer be aligned.

Electrical current will be supplied to linear actuator 146 by the controls of washing machine 2 during predetermined modes of operation, particularly spin cycles, in order to cause extension of activating rod 145. Due to the rather high spring rate associated with compression spring 130, so long as stop abutments 111 and 120 are not aligned, the extension of activating rod 145 will cause not only shifting of locking shaft 132 but also second locking element 114. This shifting of second locking element 114 causes the first and second sets of teeth 108 and 118 associated with hub portion 100 and gear portion 116 to become interengaged. In addition, up-turned terminal end 125 of arm 123 will be arranged at contact 164 of switch 159 to cause depression of contact 164. This depression of contact 164 will preferably illuminate light 32 provided on control panel 25 in order to provide an indication to the operator that front door 8 is locked. This linear shifting of second locking element 114 will continue until plate 122 abuts upright mounting plate 104. Thereafter, continued extension of activating rod 145 will cause locking shaft 132 to shift relative to second locking element 114, with spring 130 further compressing to apply an engagement pressure force for first and second sets of teeth 108 and 118, while clips 129 ride along reduced diametric portion 136. When fully extended, the terminal end of uniform diametric portion 133 will depress contact 182 of second switch 177. The depression of contact 182 is used to signal a controller for washing machine 2 that will enable the controller to allow washing basket 12 to go up to spin speed. Although the actual spin speed can vary greatly depending upon the particular cycle of the machine, these speeds generally range from between 100 and 800 rpm.

At this point, the locking mechanism of the present invention has assumed the position shown in FIG. 4, with the further extension of locking shaft 132 being indicated in dotted lines as engaging contact 182. As indicated above, the first and second sets of teeth 108 and 118 preferably constitute ratchet teeth. Therefore, once these sets of teeth 108 and 118 are engaged, first locking element 93 will only be permitted to rotate in a single direction. That is, the ratcheting of the first and second sets of teeth 108 and 118 will enable further shifting of first locking element 93 from the release position shown in FIG. 3 towards the set position shown in FIG. 4, i.e., clockwise as viewed from the direction of gear portion 116. Therefore, the locking mechanism can be further locked in order to account for changes in tolerance between the front door 8 and cabinet shell 5 during use of washing machine 2 over a prolonged period of time, but first locking element 93 cannot rotate in the opposite direction until activating rod 145 is retracted to cause disengagement between the first and second sets of teeth 108 and 118. This retraction will only be performed once washing basket 12 has reached a safe operating speed or has actually stopped. Once activating rod 145 is retracted to disengage first and second locking elements 93 and 114, catch member 43 can be withdrawn from latching cavity 46 upon tugging on front door 8. As front door 8 is opened, first locking element 93 will shift towards the release position of FIG. 3 under the biasing of spring 170.

Based on the above, it should be readily apparent that front door 8 will be maintained in a closed position across access opening 10 during various periods of the overall operation cycle of washing machine 2 merely by catch member abutting rear wall 82 of retaining element 78 which releasably holds catch member 43 in latching cavity 46. As catch member 43 is placed in this retaining position, first locking element 93 is rotated between the release position as shown in FIG. 3 and the set position as shown in FIG. 4. Due to the size of latching cavity 46, the ramping of retaining element 78 and the arrangement of latching portion 90 within latching cavity 46, a great deal of tolerance is permitted in aligning these components when assembling the overall washing machine 2.

Once first locking element 93 is shifted to the set position, second locking element 114 can be linearly shifted between the unlocked position shown in FIG. 3 to the locking position of FIG. 4, wherein gear portion 116 of second locking element 114 engages hub portion 100 of first locking element 93 to prevent rotation of first locking element 93 to the release position. This lockingly retains catch member 43 within latching cavity 46 and securely maintains front door 8 in the closed position. Further, unidirectional ratcheting between first and second sets of teeth 108 and 118 will be permitted but, first locking element 93 cannot be rotated in a direction that would enable opening of front door 8 until the first and second sets of teeth 108 and 118 become disengaged by the retraction of activating rod 145. Therefore, a positive locking mechanism is provided which will assure that front door 8 cannot be inadvertently opened when washing basket 12 is being rotated at a speed which could cause injury to an operator.

Although linear actuator 146 in accordance with the preferred embodiment constitutes a wax motor, various other types of linear actuators, including solenoids, could be readily utilized. When using a known type of wax motor, electric current supplied to the motor will cause the wax to expand in order to shift activating rod 145 against the biasing of an internal spring within the housing of linear actuator 146. The use of a wax motor is considered particularly advantageous as the wax actually acts as a timing mechanism since it cools at a specific rate. Therefore, if power was lost to washing machine 2 when the washing basket 12 was being spun at a high rate, the locking mechanism of the present invention would still remain in the locked position as the activating rod 145 would not be permitted to retract until the wax cooled. Although a similar safety function could be achieved while utilizing a solenoid by providing some type of capacitor that would dissipate electricity at a certain rate, the use of the wax motor provides this enhanced feature at a minimal increase in cost to the overall locking mechanism.

Figure 5:
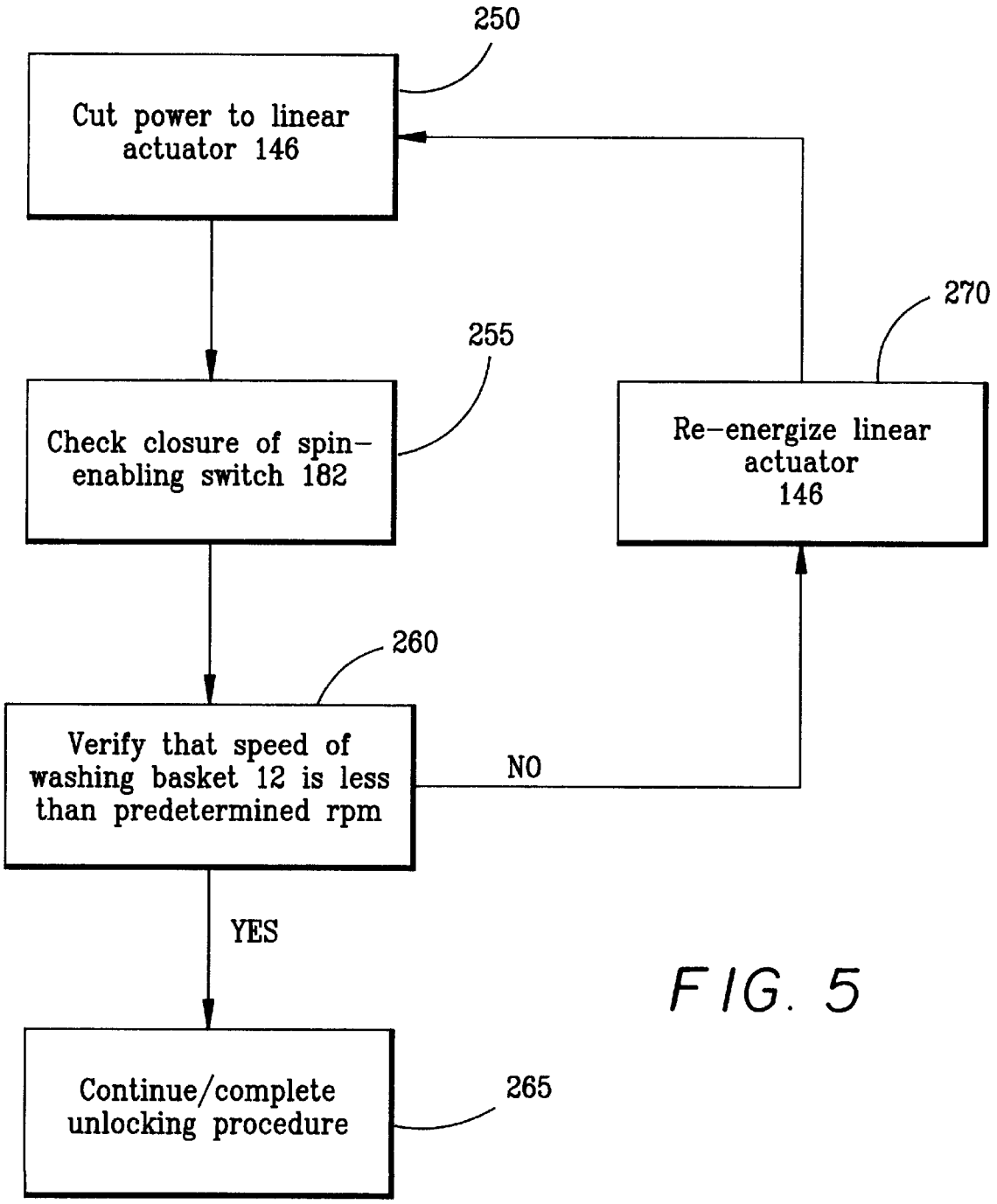
FIG. 5 illustrates a safety unlock algorithm preferably utilized in connection with the locking mechanism of the invention.

As is known in the art, washing machine 2 operates through various cycles which are timed. After washing machine 2 has proceeded through a final spin cycle, it is desirable to be able to open door 8 immediately. Therefore, it is desirable to time the disengagement between the first and second sets of teeth 108 and 118 with the termination of the final spin cycle of washing machine 2 while, at the same time, providing the enhanced safety feature outlined above. This feature of the invention is preferably accomplished by controlling the unlocking of the locking mechanism in accordance with the algorithm represented in FIG. 5.

As a given washing operation for washing machine 2 is winding down, power is first cut off to linear actuator 146 in step 250. Since the amount of time remaining in the final spin cycle is a known control factor and the time required for the wax of linear actuator 146 to cool is also known, the timing for cutting of the power to linear actuator 146 can be easily established. In the preferred embodiment, this time is in the order of two minutes before the end of the spin cycle. However, it is again important that the locking mechanism of the present invention does not enable door 8 to be opened when washing basket 12 is being spun at a high rate. Therefore, after cutting the power to linear actuator 146, it is determined whether contact 182 is closed, i.e., if the spin cycle for washing machine 2 is still enabled in step 255. The closure status of contact 182 will continue to be monitored until contact 182 opens due to a limited retraction of locking shaft 132. The speed of rotation of washing basket 12 is then ascertained (step 260), either directly or indirectly, in a manner known in the art. In the preferred embodiment, the rotating speed of an output shaft of the electric motor used to rotate washing basket 12 is sensed and inputted to a control CPU as a signal representative of the rotating speed of washing basket 12. Various known speed sensors can be utilized for this purpose, with an infrared tachometer used in combination with a shutter representing a preferred type of known sensor. As such a speed sensing arrangement for a washing machine basket is known in the art and does not form an inventive part of the present invention, it will not be further detailed herein.

At this point, it is determined whether the speed of washing basket 12 is less than a certain rpm, preferably less than 80 rpm's. If the speed is in a desired range, i.e. any speed less than this predetermined rpm, the locking mechanism will be permitted to continue its unlocking operation in step 265 wherein first and second teeth 108 and 118 will become fully disengaged as the wax in linear actuator 146 continues to cool. However, if it is determined that the rotating speed of washing basket 12 is not less than the predetermined rpm value, desired precautions are taken to assure that door 8 will not be permitted to open if washing basket 12 is being spun at a rate which could cause harm to a user upon opening of door 8. Although washing machine 2 could simply be caused to shut down, it is preferable in accordance with the present invention to re-energize linear actuator 146 under these circumstances so that the locking mechanism will not release catch member 43 from within latching cavity 46. Therefore, the controls will proceed to step 270 wherein linear actuator 146 is re-energized until it is again determined that switch 182 is closed. Thereafter, the unlocking procedure of cutting the power to linear actuator 146 (step 250), establishing the position of contact 182 (step 255) and verifying that the rotating speed of washing basket 12 is below the predetermined rpm value (step 260) is again performed until linear actuator 146 no longer needs to be re-energized, but rather the locking mechanism is simply permitted to continue its unlocking operation (step 265).

Although described with respect to a preferred embodiment of the invention, it should be readily understood that various changes and/or modifications can be made to the present invention without department from the spirit thereof. Therefore, even though the locking mechanism is shown incorporated in a horizontal axis or a tumble-type washing machine and the catch member 43 and insert housing 48 are located in the preferred position in FIG. 1, these aspects should not be considered limiting to the overall invention. Instead, the invention is only intended to be limited by the scope of the following claims.

We claim:

1. In an appliance having a cabinet provided with an access opening and a pivotal door adapted to extend across and close the access opening, a mechanism for locking the pivotal door in the closed position comprising:

a latching cavity defined in one of the door and the appliance cabinet;

a retaining element arranged in the latching cavity;

a first locking element including a hub portion and a latching portion, said first locking element being mounted for rotation between release and set positions, with the latching portion projecting into the latching cavity;

a catch member attached to another of the door and the appliance cabinet, said catch member being adapted to extend into the latching cavity, abut the retaining element to releasably hold the catch member in the latching cavity and interengage with the latching portion to cause pivoting of the first locking element from the release position to the set position when the door is pivoted to the closed position; and a second locking element shiftably mounted for movement between an unlocked position wherein the first locking element is permitted to rotate and a locking position wherein the second locking element engages the first locking element to prevent rotation of the first locking element to the release position in order to lockingly retain the catch member within the latching cavity and securely maintain the door in the closed position.

2. The mechanism according to claim 1, wherein the retaining element defines a ramp having a front sloping surface leading to a rear wall, wherein said catch member is adapted to ride up the front sloping surface and become positioned against the rear wall to releasably hold the catch member in the latching cavity when the door is pivoted to the closed position.

3. The mechanism according to claim 2, wherein the ramp is provided with a central cut-out within which the latching portion of the first locking element extends.

4. The mechanism according to claim 1, further comprising: a spring member biasing the first locking element towards the release position.

5. The mechanism according to claim 4, wherein the latching portion of the first locking element includes first and second spaced fingers defining a forked terminal end, said catch member being lodged between the first and second fingers upon closing of the door.

6. The mechanism according to claim 1, wherein the second locking element includes a gear portion adapted to directly engage the hub portion of the first locking element, each of the gear portion and the hub portion including a plurality of teeth that become interengaged when the second locking element is shifted to the locking position.

7. The mechanism according to claim 6, wherein the plurality of teeth comprise ratchet teeth which permit continued rotation of the first locking element towards the set position even when the second locking element assumes the locking position.

8. The mechanism according to claim 6, further comprising: a plurality of stop abutments interposed between the gear portion and the hub portion, said stop abutments preventing the second locking member from shifting to the locking position until the first locking member has been rotated a predetermined amount.

9. The mechanism according to claim 1, further comprising: a locking shaft defining an axis about which the hub portion of the first locking element rotates and upon which the second locking element is shiftably mounted.

10. The mechanism according to claim 9, further comprising:

an actuator for linearly shifting the second locking element between the unlocked and locking positions; and a spring interposed between the locking shaft and the second locking member biasing the second locking member against movement relative to the locking shaft.

11. The mechanism according to claim 10, further comprising: a plurality of stop abutments interposed between the first and second locking members, said stop abutments preventing the second locking member from shifting to the locking position until the first locking member has been rotated a predetermined amount.

12. The mechanism according to claim 10, wherein the linear actuator comprises a wax motor.

13. The mechanism according to claim 10, further comprising: at least one switch adapted to be engaged by one of the second locking element and the locking shaft for signaling a locking of the door by said mechanism.

14. The mechanism according to claim 10, further comprising, in combination: a basket adapted to be rotatably driven within the appliance cabinet and at least one switch adapted to be activated to enable rotation of the basket upon shifting of the second locking element to the locking position.

15. The mechanism according to claim 14, wherein the actuator linearly shifts the locking shaft in order to indirectly shift the second locking element between the unlocked and locking positions, said locking shaft including an end portion, remote from the actuator, which engages the at least one switch when the second locking element assumes the locking position.

16. The mechanism according to claim 1, further comprising:

an electrically controlled actuator for shifting the second locking element between the unlocked and locking positions;

power cut-off means for de-activating the actuator; and means for delaying the movement of the second locking element from the locking position to the unlocked position following de-activation of the actuator.

17. The mechanism according to claim 16, wherein the delaying means includes means for verifying that a sensed operating parameter of the appliance is in a desired range, said verifying means being linked to said power cut-off means to cause re-activation of the actuator if the sensed operating parameter is outside the desired range.

18. In an appliance having a cabinet provided with an access opening and a pivotal door adapted to extend across and close the access opening, a mechanism for locking the pivotal door in the closed position comprising:

a latching cavity defined in one of the door and the appliance cabinet;

a first locking element including a hub portion formed with a first set of teeth and a latching portion projecting into the latching cavity, said first locking element being mounted for rotation between release and set positions;

a catch member attached to another of the door and the appliance cabinet, said catch member being adapted to extend into the latching cavity and engage the latching portion to cause pivoting of the first locking element from the release position to the set position when the door is pivoted to the closed position; and a second locking element including a body portion having a second set of teeth shiftably mounted for linear movement between an unlocked position wherein the first and second sets of teeth are disengaged and the first locking element is permitted to rotate, and a locking position wherein the second set of teeth is interengaged with the first set of teeth to prevent rotation of the first locking element to the release position in order to lockingly retain the catch member within the latching cavity and securely maintain the door in the closed position.

19. The mechanism according to claim 18, wherein at least one of the first and second sets of teeth constitute ratchet teeth which permit continued rotation of the first locking element towards the set position even when the second locking element assumes the locking position.

20. The mechanism according to claim 18, further comprising:

a locking shaft defining an axis about which the hub portion of the first locking element rotates and upon which the second locking element is shiftably mounted;

an actuator for linearly shifting the second locking element between the unlocked and locking positions; and a spring interposed between the locking shaft and the second locking member biasing the second locking member against movement relative to the locking shaft.

21. The mechanism according to claim 18, further comprising: a plurality of stop abutments interposed between the body portion and the hub portion, said stop abutments preventing the second locking member from shifting to the locking position until the first locking member has been rotated a predetermined amount.

22. The mechanism according to claim 18, further comprising: a retaining element arranged in the latching cavity and adapted to be releasably engaged by the catch member upon closing of the door, said retaining element including a ramp surface over which the catch member rides during closing of the door.

23. The mechanism according to claim 18, further comprising, in combination: a basket adapted to be rotatably driven within the appliance cabinet and at least one switch adapted to be activated to enable rotation of the basket upon shifting of the second locking element to the locking position.

24. The mechanism according to claim 23, further comprising:

an electrically controlled actuator for shifting the second locking element between the unlocked and locking positions;

power cut-off means for de-activating the actuator; and means for delaying the movement of the second locking element from the locking position to the unlocked position following de-activation of the actuator.

25. The mechanism according to claim 24, wherein the delaying means includes means for verifying that a sensed operating parameter of the appliance is in a desired range, said verifying means being linked to said power cut-off means to cause re-activation of the actuator if the sensed operating parameter is outside the desired range.

26. A method of locking a pivotal appliance door in a closed position comprising:

causing a catch member to engage and rotate a latching portion of a first locking element from a release position to a set position within a latching cavity upon closing of the door;

linearly shifting a second locking element from an unlocked position to a locking position in engagement with the first locking element following a predetermined degree of rotation of the latching portion; and permitting continued rotation of the latching portion towards the set position and preventing the latching portion from rotating towards the release position while the second locking element is in the locking position in order to lockingly retain the catch member within the latching cavity and securely maintain the door in the closed position.

27. The method according to claim 26, further comprising:

causing the catch member to ride upon and over a ramp arranged within the latching cavity in order to releasably retain the door in the closed position, even when the second locking element is in the unlocked position.

28. A method of unlocking a mechanism used to maintain a pivotal appliance door in a closed position across an opening which provides access to a rotatable component of the appliance comprising:

de-activating a locking actuator to initiate a time delayed unlocking operation for the door;

sensing an operating parameter of the appliance representative of a rotational speed of the rotatable component;

determining whether the sensed operating parameter is within a predetermined range;

enabling the mechanism to assume an unlocked condition if the sensed operating parameter is within the predetermined range; and re-activating the locking actuator if the sensed operating parameter is outside the predetermined range.

29. The method according to claim 28, further comprising:

ascertaining a position status of a switch contact used to enable a spin mode for the rotatable component after de-activating the locking actuator; and proceeding to sense the operating parameter after the position status indicates that the spin mode is no longer enabled.

30. The method according to claim 28, further comprising: de-activating the locking actuator by cutting off power to the locking actuator.

* * * * *